US008740410B2

(12) United States Patent
Peifer et al.

(10) Patent No.: US 8,740,410 B2
(45) Date of Patent: Jun. 3, 2014

(54) TROFFER-STYLE LIGHT FIXTURE WITH CROSS-LIGHTING

(75) Inventors: Donald A. Peifer, Mountain View, CA (US); Michael A. Sanjurjo, San Jose, CA (US)

(73) Assignee: Lunera Lighting, Inc., Redwood City, CA (US)

( * ) Notice: Subject to any disclaimer, the term of this patent is extended or adjusted under 35 U.S.C. 154(b) by 438 days.

(21) Appl. No.: 12/712,743

(22) Filed: Feb. 25, 2010

(65) Prior Publication Data

US 2011/0205738 A1 Aug. 25, 2011

(51) Int. Cl.
*F21V 21/04* (2006.01)

(52) U.S. Cl.
USPC ..... 362/249.02

(58) Field of Classification Search
USPC ..... 362/217.01, 217.16, 225, 249.02, 260, 362/235
See application file for complete search history.

(56) References Cited

U.S. PATENT DOCUMENTS 3,838,268 A * 9/1974 Fabbri ..... 362/218
3,988,609 A * 10/1976 Lewin ..... 362/296.1
4,933,823 A * 6/1990 Taylor ..... 362/341
6,234,648 B1 * 5/2001 Borner et al. ..... 362/235
7,339,660 B1 * 3/2008 Cohn et al. ..... 356/237.1
7,434,959 B1 * 10/2008 Wang ..... 362/249.01
2005/0094407 A1 * 5/2005 Heald et al. ..... 362/362
2006/0146558 A1 * 7/2006 Chen et al. ..... 362/555
2008/0137324 A1 * 6/2008 Pastore ..... 362/16
2009/0262543 A1 * 10/2009 Ho ..... 362/373
2009/0290348 A1 * 11/2009 Van Laanen et al. .... 362/249.02
2010/0002433 A1 * 1/2010 Liu ..... 362/235

* cited by examiner

*Primary Examiner* — Nimeshkumar Patel
*Assistant Examiner* — Steven Horikoshi
(74) *Attorney, Agent, or Firm* — North Weber & Baugh LLP

(57) ABSTRACT

This is directed to a troffer-style light fixture using a LED light to cross-light internal surfaces of the troffer. In particular, this is directed to a troffer-style fixture having several receptacles for receiving LED modules. The modules can be inserted in the fixture such that some light emitted by the LED modules is directed towards an opposite surface of the fixture, causing light from opposite LED modules to mix as light is emitted from the fixture (e.g., cross lighting the fixture environment. The resulting light transmitted and reflected by the troffer can have softer qualities than direct light emitted by a LED module, and enhance the aesthetic appeal of light provided by the fixture. In some embodiments, one or more optical treatments can be applied to internal surfaces of the fixture to enhance the light output by the fixture.

17 Claims, 6 Drawing Sheets

TROFFER-STYLE LIGHT FIXTURE WITH CROSS-LIGHTING

BACKGROUND OF THE INVENTION

This is directed to a troffer-style light fixture using cross-lighting. In particular, this is directed to using LED lights to cross-light the internal surface of a troffer and mix light.

One of the most prolific commercial light fixtures is a fluorescent troffer fixture. This fixture includes a troffer forming a housing into which one or more fluorescent light tubes are inserted. The troffer includes a base surface from which side walls extend to form an open box. The fixture can include ballast (e.g., a power supply) for maintaining a desired orientation of the fixture when it is fixed to a surface (e.g., a ceiling). The fixture can include one or more acrylic lenses, diffusers or parabolic louvers for controlling the light emitted by the fluorescent tubes. Because fluorescent tubes emit omnidirectional light (e.g., in 360 degrees), the interior surface of the troffer fixture can include a reflector for redirecting up light (e.g., light emitted towards the fixture) down towards the environment.

To increase the power efficiency of light fixtures, some fluorescent light tubes have been replaced with LED devices. In particular, because the luminous efficacy of LED devices has increased, LEDs have become viable light sources for commercial applications. Contrary to a fluorescent light tube, however, a LED device is not omni-directional but instead may only emit light in no more than a 180 degree cone. This means that a LED based troffer will emit light down and out of the troffer, and therefore does not require a reflector along the top inner surface of the troffer. To soften the emitted light, and optimize the light for the fixture and the space where it is installed, the fixture can include one or more lenses, reflectors, diffusers and additional optics.

LED-based troffer light fixtures have some limitations, however. In particular, the luminous efficacy of LEDs can be less than that of fluorescent light tubes. For example, the luminous efficacy of LEDs can be less than 80 lumens per watt, while the luminous efficacy of fluorescent light tubes can be 100 lumens per watt. In addition, the quality of the light emitted by a LED may differ from that emitted by a fluorescent light tube. For example, a fluorescent light tube can include a powdered phosphor coating that can create a soft light. In contrast, a LED package provides a point light source that can be inherently harsher and can increase the glare profile of the fixture. To soften the harshness of LED light, diffusers with low transmission properties can be used, but such diffusers would compromise the efficiency of the fixture and eliminate the advantage of using LED-based troffer fixtures instead of fluorescent light tube-based troffer fixtures. Different approaches for LED-based troffer fixtures may be desirable to provide a better lighting experience

SUMMARY OF THE INVENTION

This is directed to a LED-based troffer light fixture in which cross-lighting is used to soften the harsher light emitted by a LED package.

A troffer-style light fixture can be provided in which a light source is provided by a LED package or a LED module including several LED packages. To soften the light emitted by the fixture, at least some of the LEDs in the LED package can be directed at an angle out of the fixture, such that the light emitted by several LED packages can intersect and combine or mix outside of the fixture. In some embodiments, an interior surface of the troffer can be treated with one or more coatings so that some light emitted by the LED (e.g., light emitted towards the interior surface of the troffer) can reflect from the interior surface and be more evenly distributed from the fixture. For example, the interior surfaces of the troffer can be coated with two or more separate optical layers selected for special mixing of light to maximize performance and aesthetics. In some embodiments, the optical treatment can be selected based on color properties of the reflected and transmitted light of the troffer (e.g., to maximize color properties).

The LEDs can be distributed within the fixture using any suitable approach. In some embodiments, some LEDs can be positioned at opposite ends of the troffer, and oriented at an acute angle relative to a plane perpendicular to the troffer interior surface. The LEDs can then emit light across the troffer such that the emitted light can mix within and out of the fixture, and more evenly illuminate the environment of the fixture.

In some embodiments, the LED module used in a troffer can be removable. For example, the troffer can include a receptacle or receiving structure for receiving a LED module. The receptacle can have any suitable size, including for example one of several standard sizes. The particular size selected for a receptacle can be determined, for example, by the troffer size, or by the lighting requirements for the environment in which the fixture is installed. By allowing the LED module to be removable and replaced, the fixture can be easily serviced and used once an initial LED module reaches its useable lifetime.

The light emitted by a particular fixture can be adjusted using different approaches. In some embodiments, the size of a LED module placed in the fixture can be selected based on a desired light output. For example, a LED module can be selected based on the number of individual LED packages available in the module (e.g., using LED modules with different dimensions and a constant LED density, or LED modules with a variable LED density). In some embodiments, the fixture can include one or more features for limiting the light output by the LED module. For example, the receptacle can include one or more openings or slots through which light emitted by the LEDs can propagate. In some embodiments, the number of slots or openings can be adjusted based on the lighting requirements for the fixture environment. This approach can allow, for example, a same fixture to provide light at 30 lumens per watt or 80 lumens per watt.

BRIEF DESCRIPTION OF THE DRAWINGS

The above and other features of the present invention, its nature and various advantages will be more apparent upon consideration of the following detailed description, taken in conjunction with the accompanying drawings in which.

DETAILED DESCRIPTION

This is directed to a troffer-style fixture using a LED module to provide a light source. At least some of the LEDs in the module can direct light out of the troffer at an angle such that the light can combine and mix before reaching objects in the environment.

Figure 1:
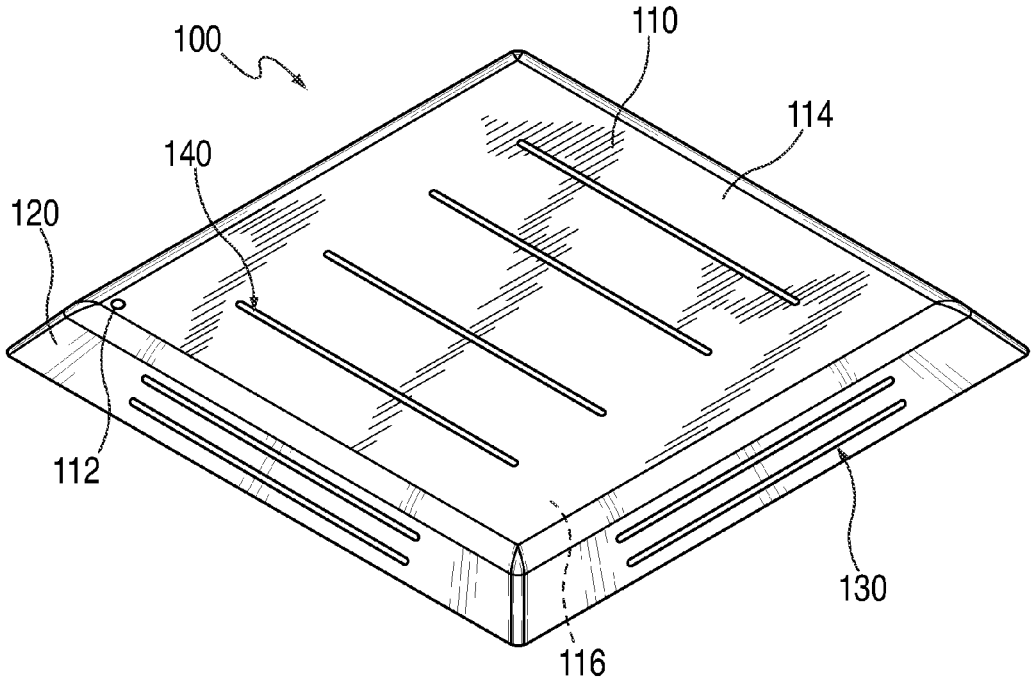
FIG. 1 is a schematic view of an illustrative troffer from for use in a LED-based fixture in accordance with one embodiment of the invention.

FIG. 1 is a schematic view of an illustrative troffer from for use in a LED-based fixture in accordance with one embodiment of the invention. Fixture 100 can include frame 110 supporting a light source and directing the light out of the fixture. Frame 110 can be constructed from back plate 112 from which side walls 120 can extend. Back plate 112 can define a substantially planar surface serving as a base structure for the fixture. In some embodiments, back plate 112 can instead or in addition include a non-planar surface, such as a curved back surface. Back plate 112 can include internal surface 116 exposed to a LED light source, and external surface 114 exposed to the environment. In some embodiments, external surface 114 can include one or more components for connecting frame 110 to a ceiling or other environment structure.

Side walls 120 can extend from back plate 112 such that side walls 120 extend out of the plane of back plate 112. The side walls can extend from the back plate at any suitable angle, including for example at an angle in the range of 0 to 60 degrees from vertical (e.g., towards or away from the center of the back plate) such that the side walls can slope at an angle. In some embodiments, the side walls can extend at a variable angle (e.g., creating a wave-like side wall), based for example on the position relative to the periphery of back plate 112, or based on target light output.

The side walls of fixture 100 can extend around any suitable portion of back plate 112. For example, side walls 120 can extend substantially continuously around the periphery of back plate 112. As another example, side walls 120 can include one or more openings through which light can propagate out of the fixture. As still another example, the height of side walls 120 can vary around the periphery of back plate 112 (e.g., side walls 120 can have a non-rectangular shape).

Fixture 100 can include one or more LED modules that include LED devices operative to provide light. The LED modules can be installed on any suitable portion of fixture 100. In some embodiments, fixture 100 can include several receptacles (e.g., slots extending through the fixture) operative to receive and secure a LED module. The receptacles can be positioned at any suitable location on the device, including on one or both of back plate 112 and side walls 120. For example, fixture 100 can include a first set of receptacles 130 positioned on the side walls (e.g., along the length of the side walls). In the case where the base plate substantially forms a rectangle and the side wall segments extend from each of the sides of the rectangle, receptacles 130 can be positioned along all of the side wall segments, opposite side wall segments, adjacent side wall segments, or combinations of these (e.g., along side wall segments that are not adjacent). Each side wall can include any suitable number of receptacles, including for example several receptacles per side wall segment (e.g., two or three slots). Each receptacle can have any suitable size, including for example a uniform, standard size or a variable size. In some embodiments, the size of receptacle 130 can be selected based on the size of LED modules available for the fixture. For example, receptacle 130 can be sized to receive one or more sizes of LED modules (e.g., LED modules having a retention wall length in a range of available sizes, or a length of one of several available lengths). In some cases, each receptacle 130 can include different securing features to ensure that LED modules of different sizes can be received and retained within a receptacle 130. Receptacles 130 can include a removable or releasable securing mechanism such that a LED module can be removed and replaced within fixture 100.

In some embodiments, back plate 112 can instead or in addition include receptacles 140 for receiving LED modules. Receptacles 140 can include some or all of the features of receptacles 130, described above, and can be positioned along internal surface 114 using any suitable approach. For example, receptacles 140 can define several parallel slots (e.g., along the length of back plate 112). As another example, receptacles 140 can define a geometric shape (e.g., a square or rectangle). Each of receptacles 140 can have any suitable size, including for example a uniform or different size.

Receptacles 130 and 140 can be defined such that LED modules do not need to be placed in all of the receptacles to provide a desirable light output. In particular, the receptacles can be recessed or have a low profile such that unused receptacles do not interfere with light emitted by LED modules positioned in adjacent receptacles. In some embodiments, one or more of the unused receptacles can be covered to prevent undesirable optical effects.

Figure 2:
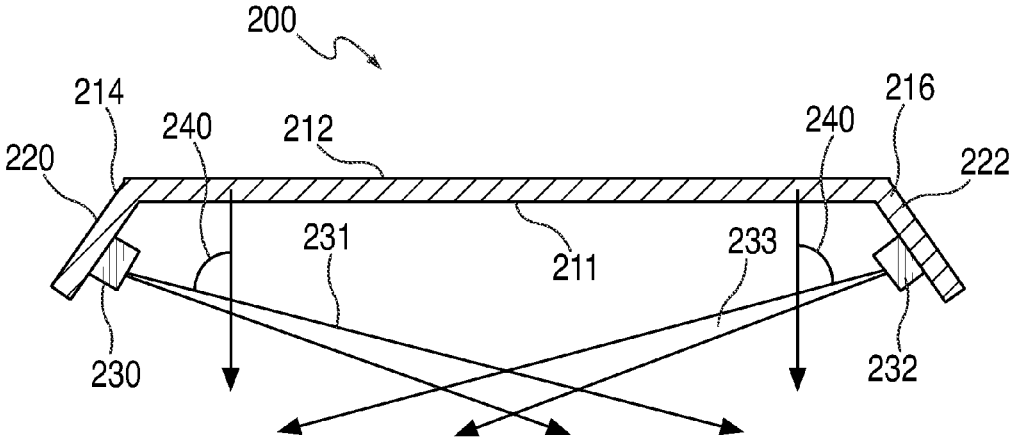
FIG. 2 is a cross-sectional view of an illustrative fixture in which cross-lighting is implemented in accordance with one embodiment of the invention.

To enhance the light output by fixture 100, some of the receptacles (e.g., receptacles 130) can be positioned to cross-light the environment. In particular, LED modules can be placed in opposite side walls 120 of fixture 100 such that light emitted by LED modules retained in the side walls are directed to portions of the environment adjacent to the opposite side walls. FIG. 2 is a cross-sectional view of an illustrative fixture in which cross-lighting is implemented in accordance with one embodiment of the invention. Fixture 200 can include back plate 212 and side walls 220 and 222. Side wall 220 can extend from first side 214 of the back plate, and side wall 222 can extend from second side 216 of the back plate. Each side wall can include LED modules 230 and 232, respectively operative to emit light substantially within cones 231 and 233. The LED modules can be oriented such that light emitted by package 230, positioned on side wall 220, is substantially oriented towards opposite side 216 of fixture 200, while light emitted by package 232, positioned on side wall 222, is substantially oriented towards opposite side 214 of fixture 200.

The light emitted by packages 230 and 232 can be oriented at any suitable angle relative to a plane perpendicular to back plate 210 (e.g., at any suitable angle 240). For example, the light emitted by the packages can be oriented at an angle in the range of 5 to 65 degrees, 20 to 50 degrees, or 30 to 40 degrees. As another example, the light emitted by the packages can be oriented at an angle less than 42 degrees, but more than 2 or 5 degrees. This approach can allow the light emitted by LED modules 230 and 232 to mix as it leaves fixture 200 (e.g., moves beyond the edges of walls 220 and 222) and propagates into the environment.

The modules can be oriented such that emitted light can mix or be substantially mixed at any suitable distance from the fixture. For example, the modules can be oriented such that substantial amounts of emitted light can mix at a vertical distance of less than 12 feet, 10 feet, 8 feet, 6 feet, 4 feet, or 2 feet from the troffer (e.g., from the back plate along a plane perpendicular to the plane of the back plate). As another example, the modules can be oriented such that substantially amounts of emitted light can mix at a vertical distance in the range of 2 feet to 12 feet, 4 to 8 feet, 5 to 7 feet, or 6 feet from the troffer. This cross-lighting can provide a mixed light can have softer optical properties than direct light emitted in each of cones 231 and 233 (or light emitted vertically from LED modules coupled to back plate 212), and provide a more pleasing lighting experience. In some embodiments, the mixed light can further be combined with down light emitted by LED modules (e.g., light emitted from LED modules coupled to back plate 212 and directed vertically out of fixture 200).

In some embodiments, internal surface 211 of back plate 210 can be treated to enhance the mixing of light and the quality of the light reflected and transmitted by the fixture. In particular, because the light emitted by each of LED modules 230 and 232 can include stray or additional light emitted out of cones 231 and 233, respectively (e.g., light emitted in a 180 degree cone), some light may reach internal surface 211. Although the following discussion will describe surface treatments applied to internal surface 211, it will be understood that the same or different surface treatments can be applied to any other portion of fixture 211, including for example internal surfaces of side wall 220. In one implementation, materials can be incorporated in the troffer material (e.g., as part of the manufacturing process) to modify the optical properties of the troffer material. In another implementation, internal surface 211 can be polished or roughened to control the manner in which light reflects from the surface. Alternatively or in addition, one or more surface treatments can be applied to internal surface 211. In particular, one or more layers of material can be deposited on internal surface 211 to modify or refine the optical properties of the internal surface. Material can be deposited using any suitable approach, including for example using a powder coating, film deposition, physical vapor deposition (PVD), painting, thin film process, or combinations of these. In some embodiments, one or more masks can be used to selectively apply material on internal surface 211.

Any suitable material can be applied to internal surface 211. For example, materials for converting wavelengths can be used, such as phosphor or quantum dots. The materials can be applied in one or more layers having different thicknesses. For example, thin layers of material (e.g., layers having thicknesses in the range of 20 nm to 500 nm) can be deposited on internal surface 211. Alternatively or in addition, thicker layers (e.g., layers having thicknesses in the range of 500 nm to 500 μm) can be applied to internal surface 211.

The particular processes, materials, thicknesses of layers, order of layers, and other surface treatment attributes can be selected based on any suitable criteria. In some embodiments, the surface treatment attributes can be selected based on a desired light output from the fixture. For example, the surface treatment can be selected to maximize performance and aesthetics of the fixture (e.g., to maximize color properties of output light).

Figure 3:
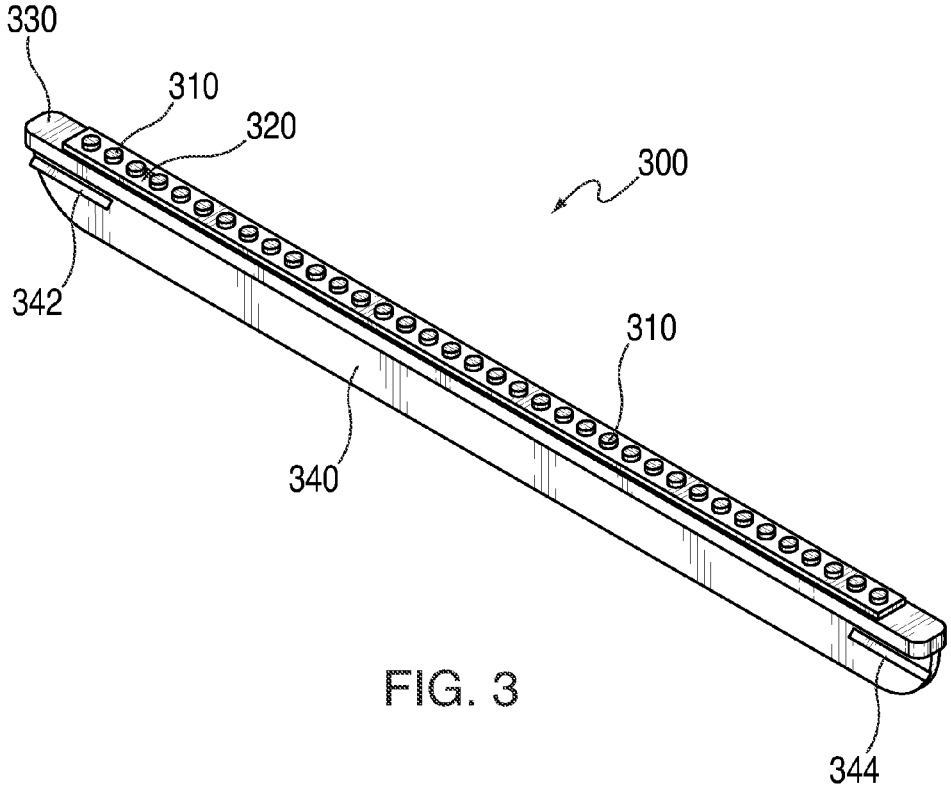
FIG. 3 is a schematic view of an illustrative LED module for use in a fixture having cross-lighting in accordance with one embodiment of the invention.
Figure 4:
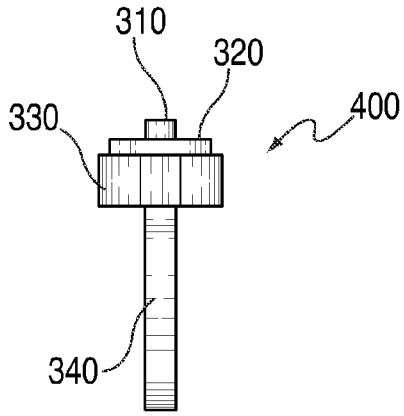
FIG. 4 is a cross-sectional view of the LED module of FIG. 3 in accordance with one embodiment of the invention.

Any suitable LED module or LED package can be placed within the fixture. In some embodiments, a LED package can be included in a LED module having a PCB and a heat sink, and the LED module can be mounted to the fixture. FIG. 3 is a schematic view of an illustrative LED module for use in a fixture having cross-lighting in accordance with one embodiment of the invention. FIG. 4 is a cross-sectional view of the LED module of FIG. 3 in accordance with one embodiment of the invention. LED module 300 can include individual, small LED packages 310 mounted on circuit board 320. Alternatively, LED module 300 can include one or more larger LED packages (e.g., mounted to circuit board 320). LED module 300 can include any suitable number of LED packages 310, including for example a number determined from a desired package density and dimensions of the module. As another example, the number of LED packages can be determined from a desired light output by LED module 300. The LED packages can receive power using any suitable approach, including for example by coupling a power connector of circuit board 320 (not shown) to a power source of the fixture (e.g., to a connector of the fixture that is in turn connected to an external power source).

The LED packages of module 300 can be oriented in any suitable manner. In some embodiments, individual LED packages can be positioned to emit light along a particular orientation or in a particular direction. For example, one or more LED packages can be oriented such that light is emitted substantially perpendicular to circuit board 320. As another example, one or more LED packages can be oriented to emit light at an angle relative to circuit board 320 such that light can be oriented towards a distant or opposite portion of the fixture (e.g., orient the LED packages at an angle in the range of 5 to 160 degrees relative to perpendicular from the circuit board), or at an angle beyond or out of the fixture.

Because each LED package can generate substantial amounts of heat, module 300 can include heat sink 330 operative to dissipate heat generated by each LED package 310. Heat sink 330 can be positioned near or in contact with the LED packages using any suitable approach, including for example by placing heat sink 330 in contact with circuit board 320. LED packages 310, circuit board 320, or both can be coupled to heat sink 330 using any suitable approach. In some embodiments, the circuit board can be connected to the heat sink using a permanent fixing approach (e.g., an adhesive, tape, heat staking, soldering, welding, or a mechanical fixture). This approach may allow a user to replace module 300 and re-use the fixture. In some cases, however, the circuit board can be removably coupled to heat sink 330, for example using a mechanical fastener, an adhesive, hook and fastener material such as Velcro®, or combinations of these. This approach may allow a user to replace only the circuit board and LED modules.

Heat sink 330 can have any suitable size, including for example a size that is selected based on the number of LED packages 310 in module 300, the size of circuit board 320, the power provided to the LED packages, the space in which module 300 is placed, combinations of these criteria, or any other suitable criteria. In some embodiments, heat sink 330 can have a standard or uniform size, for example selected based on the size of receptacles in light fixtures. In one particular implementation, heat sink 330 can have a single size on which different amounts of LED packages can be mounted, such that the heat sink can be coupled to any fixture, but the amount of light provided by the module can be variable.

To retain module 300 within the fixture, module 300 can include retention feature 340. For example, retention feature 340 can include a thin wall extending from heat sink 330 and operative to be inserted into a receptacle (e.g., through a slot) of the fixture. In some embodiments, retention feature 340 can be constructed as part of heat sink 330 (e.g., as part of the same component). For example, feature 340 and heat sink 330 can be different portions of an extruded, cast, molded, or machined component.

Module 300 can include any suitable number of retention features 340 having any suitable shape or distribution. For example, module 300 can include several parallel retention features 340 (e.g., parallel walls) extending from heat sink 330. As another example, retention feature 340 can include one or more discontinuous walls, or a wall having a variable height, or a varying angle relative to the plane of heat sink 330. Retention feature 340 can extend from any suitable portion of heat sink 330, including substantially the centerline of heat sink 330, off-center, combinations of these, or a position selected to facilitate dissipation of heat produced by LED packages 310 (e.g., align a retention feature 340 with LED packages 310 of the module).

To engage module 300 within the fixture, any suitable portion of module 300 can include a feature for engaging the fixture and retaining the module within the fixture body. Although the following discussion will describe the retention means as part of retention feature 340, it will be understood that any portion of module 300 can be used to retain the module in a fixture. Retention feature 340 can include any suitable element for engaging a fixture. For example, retention feature 340 can include a hook, slot, cut, opening, or combinations of these. In particular, retention feature 340 can include slots 342 and 344 located at opposite ends of module 300, such that a portion of the fixture wall (e.g., a portion of a troffer side wall) can extend into each of slots 342 and 344. Slots 342 and 344 can have any suitable length, including for example different lengths (e.g., a longer length 344) such that module 300 can be inserted into a fixture by placing retention feature 340 within a fixture slot, engaging the fixture wall into module slot 344, and then sliding module 300 within the fixture slot such that the fixture wall is positioned within both module slots 342 and 344. In some embodiments, a mechanical fastener or a spring can be incorporated in one or both of the module and fixture to retain the module within the fixture.

In some embodiments, other means or mechanisms can be used to retain module 300 within the fixture. For example, retention feature 340 can include a mechanical fastener or a feature for receiving a mechanical fastener (e.g., a hole or threads for receiving a bolt). As another example, retention feature 340 can include a surface for an adhesive, hook and fastener material (e.g., Velcro®), a protrusion, hook, claw, opening, indentation, aperture, or combinations of these.

Figure 5A:
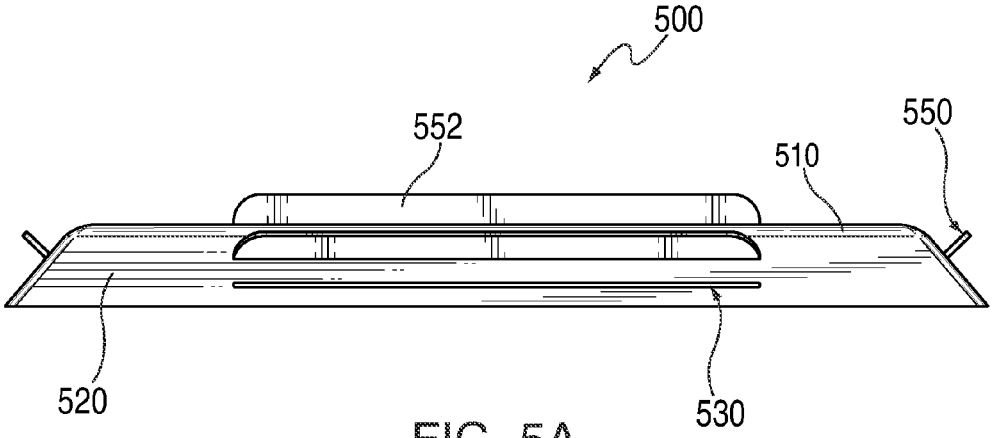
FIG. 5A is a side view of an illustrative fixture in which LED modules are inserted in accordance with one embodiment of the invention.
Figure 5B:
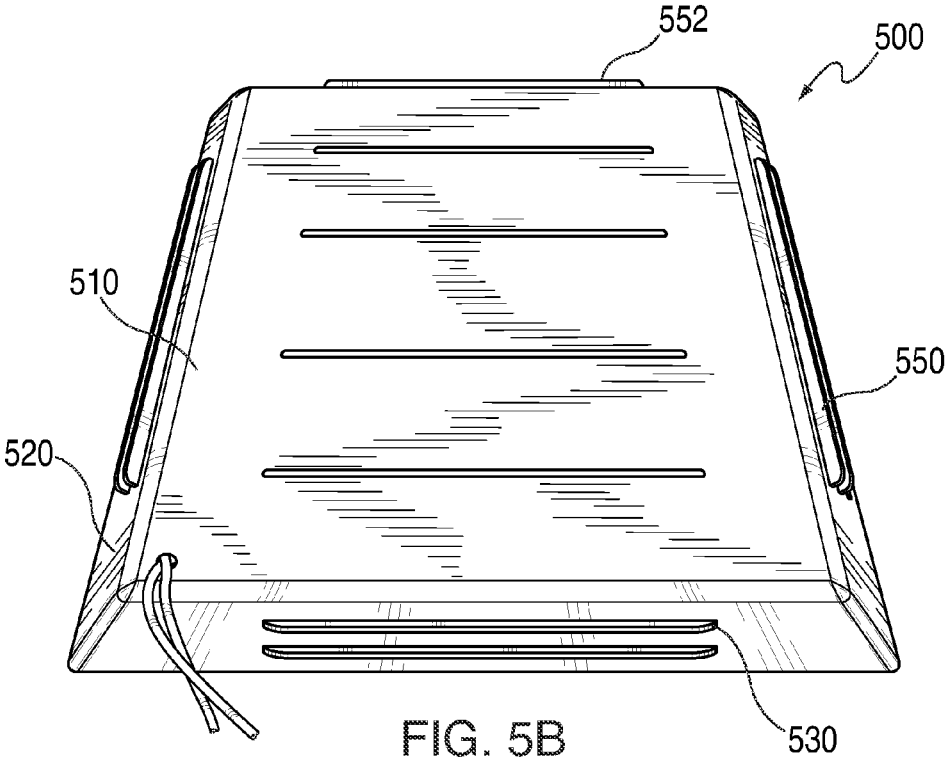
FIG. 5B is a perspective view of the illustrative fixture of FIG. 5A in accordance with one embodiment of the invention.

The LED modules can be inserted in the troffer-style fixture using any suitable approach. FIG. 5A is a side view of an illustrative fixture in which LED modules are inserted in accordance with one embodiment of the invention. FIG. 5B is a perspective view of the illustrative fixture of FIG. 5A in accordance with one embodiment of the invention. Fixture 500 can include several receptacles 530 in side walls 520 of the fixture for retaining LED modules 550. In particular, receptacles 530 can include slots running along a portion of the length of each side wall 520. Retention feature 552 of LED module 550 can be inserted in each receptacle 530 such that each LED module can be secured in the fixture. In the particular example of FIG. 5, a LED module 550 is inserted in each of the four side walls 520 of fixture 500.

In some embodiments, retention feature 552 can extend through a slot in the side wall of fixture 100 such that retention feature 552 is positioned adjacent to the outer surface of side wall 520, while the LED package of LED module 550 is positioned adjacent to the inner surface of side wall 520. When retention feature 552 serves as part of the heat sink, heat generated by the LED packages can be conducted out of the volume enclosed by fixture 500 (e.g., the internal volume enclosed by back plate 510 and side walls 520) by retention feature 552 for more efficient dissipation. Receptacles 530 can engage retention feature 552 using any suitable approach. In some embodiments, retention feature 552 can be sized relative to the size of receptacles 530 such that once inserted in the receptacle, friction between retention feature 552 and the receptacle (e.g., friction between the sides of the slot and the surface of the retention wall) maintain the LED module within the fixture.

Power can be routed to each LED module using any suitable approach. In some embodiments, a power source (not shown) can connect to a portion of fixture 500, and be routed internally within the fixture to each of LED modules 550. In particular, a conductor (e.g., one or more wires or cables, or a flex circuit) can electrically connect the power source to a connector associated with each receptacle 530. When a LED module 550 is inserted in a receptacle 530, the connector of the receptacle can be electrically connected to a corresponding connector of the LED module (e.g., a connector associated with a PCB of the LED module). In some embodiments, each LED module can instead or in addition be soldered or connected using a SMT process to the conductor leading to the power source.

Figure 6:
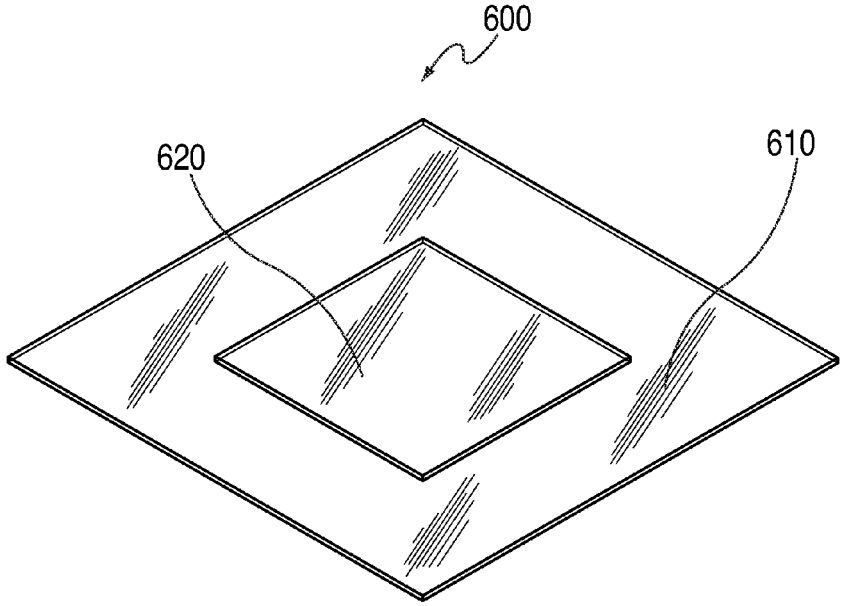
FIG. 6 is a schematic view of an illustrative optical element placed over LED modules in accordance with one embodiment of the invention.

FIG. 6 is a schematic view of an illustrative optical element placed over LED modules in accordance with one embodiment of the invention. Optical element 600 can include one or more different optical regions, including for example distinct diffusers. In one implementation, optical element 600 can include hot diffuser region 610 surrounding cold diffuser region 620. The diffuser regions can be distributed on optical element 600 using any suitable approach, including for example in regions having same or different sizes, same or different shapes (e.g., rectangular or circular shapes), a regular or arbitrary distribution of regions, or combinations of these. Each region of optical element 600 can have any suitable optical property. For example, hot diffuser region 610 can provide heavier diffusion in cross-lighting arrangement (e.g., using several layers of diffusing material or components coated on optical element 600). In particular, hot diffuser region 610 can include a lower transmission to lower the luminance of emitted light and spread the light beam. As another example, cold diffuser region 620 can provide lighter diffusion to transmit as much of the reflected light out of the fixture as possible (e.g., using a single layer of diffusing material, or no material coated on optical element 600).

The specific distribution of the diffuser regions can be selected using any suitable criteria. For example, the distribution can be selected based on the distribution of LED modules within the fixture (e.g., reverse the distribution of the diffuser regions if the LED modules are mounted in the troffer back plate instead of the troffer side walls). In some embodiments, one or more of the regions of optical element 600 can include an optical treatment (e.g., tinting, lenses, prismatic films, or wavelength converting materials) to adjust or maximize color properties of the fixture.

Figure 7A:
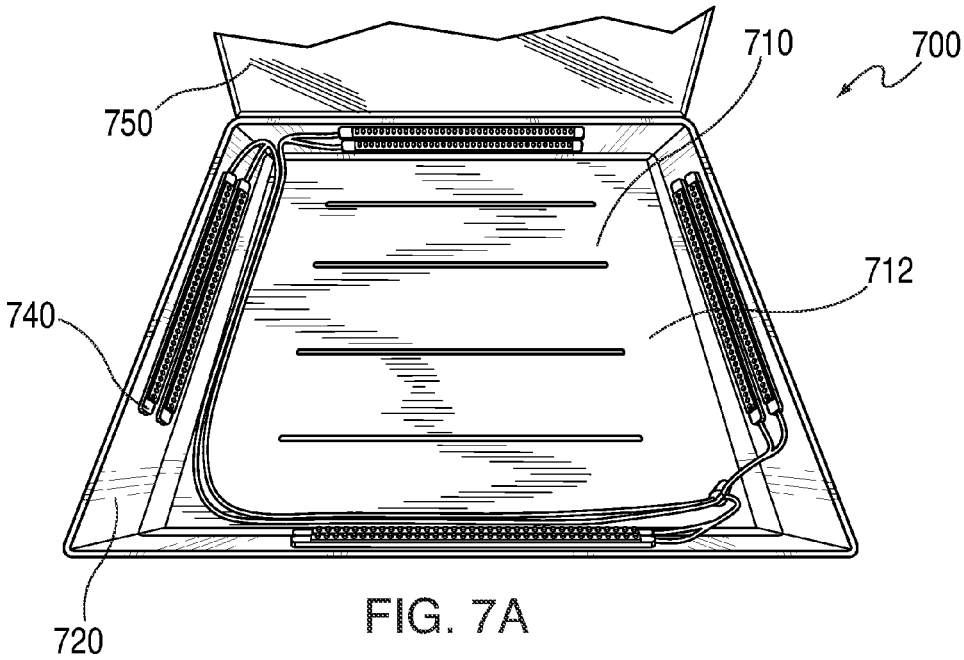
FIG. 7A is a schematic view of a fixture providing cross-lighting using LED modules in which an optical element is removed in accordance with one embodiment of the invention.
Figure 7B:
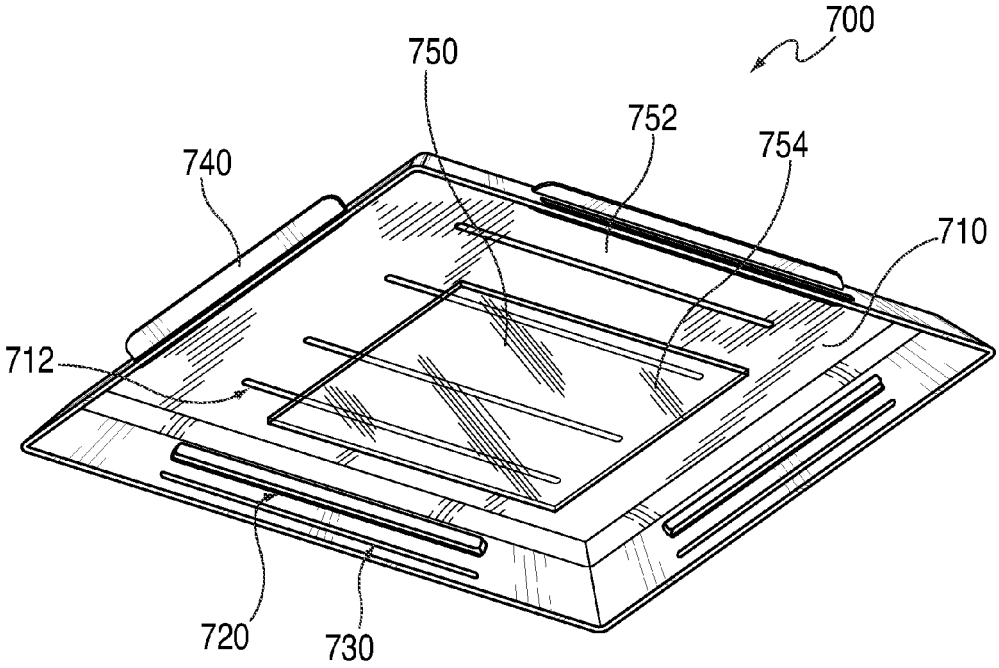
FIG. 7B is a schematic view of the fixture of FIG. 7B in which the optical element is placed over the fixture in accordance with one embodiment of the invention.

FIG. 7A is a schematic view of a fixture providing cross-lighting using LED modules in which an optical element is removed in accordance with one embodiment of the invention. FIG. 7B is a schematic view of the fixture of FIG. 7B in which the optical element is placed over the fixture in accordance with one embodiment of the invention. Fixture 700 can include troffer 710 defining back plate 712 and side walls 720.

Side walls 720 can include receptacles 730 for receiving LED modules 740. Fixture 700 can include optical element 750 that can be removably coupled to troffer 710. In one implementation, one side of optical element 710 can be coupled to a side wall segment using a hinge. The optical element can be secured to troffer 710 to close the fixture using any suitable approach, including for example using one or more engagement mechanisms (e.g., on one or both of troffer 710 and optical element 750). As shown in FIG. 7B, optical element 750, which can include distinct regions 752 and 754 (e.g., hot and cold diffuser regions) positioned over LED modules 740.

Figure 8:
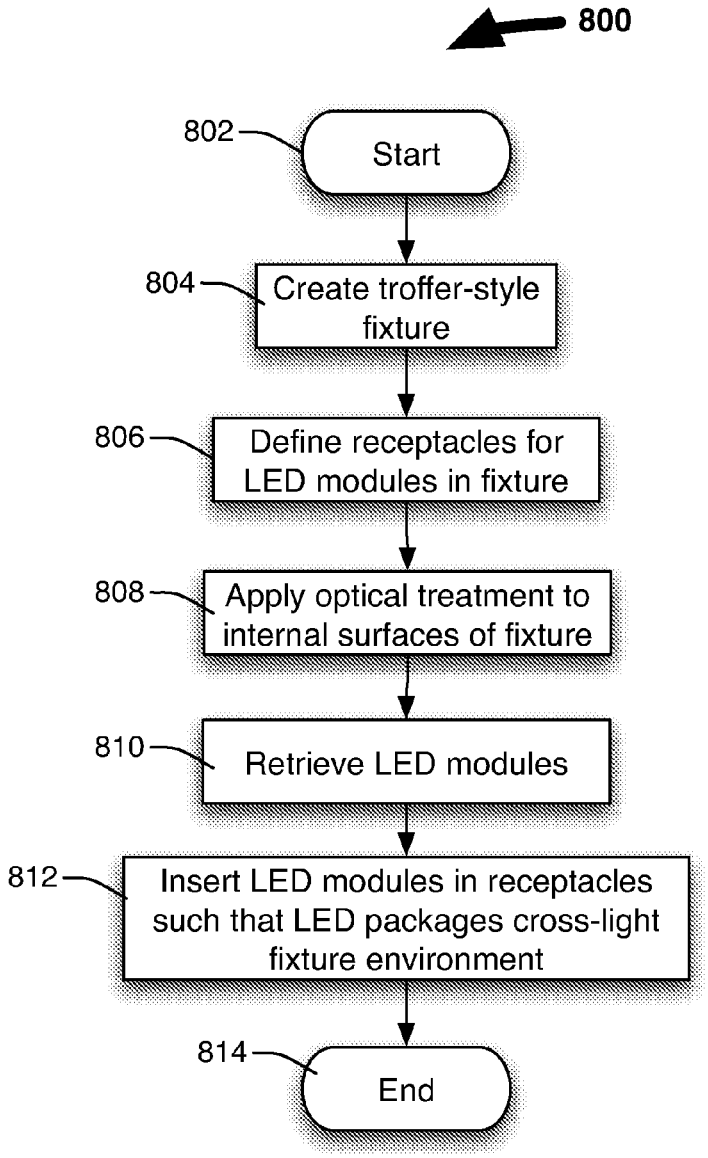
FIG. 8 is a flow chart of an illustrative process for assembling a LED-based fixture that uses cross-lighting in accordance with one embodiment of the invention.

FIG. 8 is a flow chart of an illustrative process for assembling a LED-based fixture that uses cross-lighting in accordance with one embodiment of the invention. Process 800 can begin at step 802. At step 804, a troffer-style fixture can be created. For example, a troffer can be molded from plastic. As another example, a sheet or block of material can be worked (e.g., machined or pressed) to form a troffer. In some embodiments, the resulting troffer can include a back plate from which side walls extend. At step 806, receptacles for receiving and retaining LED modules can be defined in the fixture. For example, receptacles can be defined in one or both of a back plate and side walls of the fixture (e.g., cut slots in one or both of the surfaces). Any suitable number of receptacles can be defined, including several receptacles of same or varying sizes in a single surface or region of the troffer.

At step 808, optical treatments can be applied to internal surfaces of the fixture. For example, one or more surface treatments can be applied to internal surfaces of one or both of the back plate and side walls of the troffer. As another example, materials can be inserted in the material used to create the troffer to modify the optical properties of the troffer during step 804. Any suitable optical treatment can be used, including for example surface treatments by which several layers of material can be applied to internal surfaces of the troffer. At step 810, LED modules can be retrieved. For example, LED modules corresponding to the size of the defined receptacles can be retrieved. As another example, LED modules appropriate for the environment (e.g., the room) in which the fixture will be placed can be retrieved (e.g., LED modules having an appropriate power production, or LED modules having an appropriate LED package density).

At step 812, the LED modules can be inserted in the receptacles such that LED packages of the modules cross-light the environment of the fixture. For example, the LED modules can be oriented within the fixture such that the light transmission cone associated with LED packages directs emitted light adjacent to a region of the environment opposite the position of the LED module within the fixture (e.g., emit light across the fixture). When LED modules are positioned on opposite ends of the fixture, emitted light from the LED modules can mix in and out of the fixture. Process 800 can then move to step 814 and end.

The above-described embodiments of the present invention are presented for purposes of illustration and not of limitation, and the present invention is limited only by the claims which follow.

What is claimed is:

1. An LED-based light fixture, comprising:

a troffer comprising:

a back plate;

side walls extending from a periphery of the back plate; and at least two receptacles positioned apart from each other, the at least two receptacles coupled to at least one of the back plate and the side walls; and at least two LED modules, wherein the LED modules are retained by the at least two receptacles such that light emitted by each of the at least two LED modules is substantially oriented toward another of the at least two LED modules and, wherein the at least two LED modules include a retention wall extending from a body of the LED modules and the retention wall includes two module slots such that a portion of at least one of the back plate and the side walls is able to extend into one of the two module slots to thereby releasably secure the at least two LED modules to the troffer.

2. The LED-based light fixture of claim 1, wherein:

the side walls comprise at least two side wall sections positioned on opposite ends of the troffer; and the at least two receptacles are coupled to each of the at least two side wall sections.

3. The LED-based light fixture of claim 2, wherein:

the light emitted by each of the at least two LED modules is substantially oriented out of the fixture towards a region that is substantially closer to the one of the at least two receptacles that does not retain the one of the at least two LED modules than to the one of the at least two receptacles that retains the one of the at least two LED modules.

4. The LED-based light fixture of claim 3, wherein:

the light emitted by the at least two LED modules mixes as it propagates out of the fixture.

5. The LED-based light fixture of claim 1, wherein:

the light emitted by each of the at least two LED modules is substantially oriented in a direction that is in the range of 5 to 42 degrees from a plane perpendicular to a plane of the back plate.

6. The LED-based light fixture of claim 1, wherein:

the at least two receptacles comprise at least two slots extending through the troffer.

7. The LED-based light fixture of claim 6, wherein the retention wall is operative to be inserted in one of the at least two slots.

8. The LED-based light fixture of claim 7, wherein:

a portion of the retention wall is operative to extend out of a volume of the troffer defined by the back plate and side walls.

9. The LED-based light fixture of claim 7, wherein:

the body of the LED modules comprises at least one LED package, a circuit board, and a heat sink; and the retention wall serves as a portion of the heat sink.

10. A method for constructing an LED-based light fixture, comprising:

defining a troffer comprising a back plate and side walls defining an internal volume; and coupling at least two LED modules to the troffer, wherein the at least two LED modules direct light out of the internal volume such that at least a substantial portion of the light directed by each of the at least two LED modules intersects before reaching a distance of 6 vertical feet from the troffer, and wherein the at least two LED modules include a retention wall extending from a body of the LED modules and the retention wall includes two module slots such that a portion of at least one of the back plate and the side walls is able to extend into one of the two module slots to threby releasably secure the at least two LED modules to the troffer.

11. The method of claim 10, further comprising:

defining at least two receptacles in the troffer for receiving the at least two LED modules.

12. The method of claim 11, further comprising:

releasably securing the at least two LED modules in the at least two receptacles.

13. The method of claim 11, wherein:

defining further comprises defining the at least two receptacles in the side walls of the troffer.

14. The method of claim 11, wherein:

defining further comprises cutting at least two slots extending through the surface of the troffer.

15. The method of claim 14, wherein:

the at least two LED modules output different amounts of light but have the same size; and the at least two slots have the same size.

16. The method of claim 10, further comprising:

applying an optical treatment to an internal surface of the troffer reached by the light directed by each of the at least two LED modules.

17. The LED-based light fixture of claim 5, wherein the range is larger than 5 degrees and smaller than 30 degrees.

* * * * *